US006541949B2

(12) United States Patent
Sirito-Olivier

(10) Patent No.: US 6,541,949 B2
(45) Date of Patent: Apr. 1, 2003

(54) CURRENT SOURCE WITH LOW TEMPERATURE DEPENDENCE

(75) Inventor: Philippe Sirito-Olivier, St Egreve (FR)

(73) Assignee: STMicroelectronics S.A., Montrouge (FR)

( * ) Notice: Subject to any disclaimer, the term of this patent is extended or adjusted under 35 U.S.C. 154(b) by 70 days.

(21) Appl. No.: 09/864,869

(22) Filed: May 24, 2001

(65) Prior Publication Data

US 2002/0021116 A1 Feb. 21, 2002

(30) Foreign Application Priority Data

May 30, 2000 (FR) ..... 00 06908

(51) Int. Cl.[7] ..... G05F 3/28
(52) U.S. Cl. ..... 323/315; 323/907
(58) Field of Search ..... 323/312, 313, 323/314, 315, 907; 327/512, 513

(56) References Cited

U.S. PATENT DOCUMENTS 4,563,632 A 1/1986 Palara et al. ..... 323/316
5,430,395 A * 7/1995 Ichimaru ..... 327/512 X
5,455,504 A 10/1995 Suzuki et al. ..... 323/316
5,557,194 A 9/1996 Kato ..... 323/315
5,686,822 A 11/1997 Croft et al. ..... 323/312
5,926,062 A 7/1999 Kuroda ..... 327/538

OTHER PUBLICATIONS

Smith et al., *Evolution of High Speed Operational Amplifier Architectures,* IEEE Journal of Solid State Circuits vol. 29, No. 10, Oct. 1994.

Grey et al., *Analysis and Design Analog Integrated Circuits,* Third Edition, 1993, pp. 324, 325, and 345 (No Month).

* cited by examiner

*Primary Examiner*—Jessica Han
(74) *Attorney, Agent, or Firm*—Allen, Dyer, Doppelt, Milbrath & Gilchrist, P.A.; Lisa K. Jorgenson

(57) ABSTRACT

A current source with low temperature dependence includes a reference current source and a current mirror for copying the reference source current to at least one output branch. The reference current source and the current mirror may have opposite coefficients of temperature dependence and the current mirror may be a weighted mirror. The present invention is particularly applicable to the manufacture of integrated circuits.

23 Claims, 4 Drawing Sheets

CURRENT SOURCE WITH LOW TEMPERATURE DEPENDENCE

FIELD OF THE INVENTION

The present invention relates to the field of electronic circuits, and, more particularly, to a current source with a low coefficient of temperature dependence.

BACKGROUND OF THE INVENTION

A coefficient of temperature dependence is a parameter which, for an electronic device, relates the variations in the device's output characteristics (i.e., its output current) to the variations in its operating temperature. The operating temperature may be especially influenced by ambient temperature. The temperature dependence coefficient may be defined both for a device in its entirety and for its constituent parts.

The present invention finds applications, for example, in the manufacture of electronic integrated circuits and in circuits including a current source. In particular, the invention may be useful for the manufacture of integrated circuits or circuit components requiring a current source having very little sensitivity to variations in temperature, such as oscillators, for example. Oscillators may be used in portable transceivers that are powered by battery and may be used at highly variable temperatures, for example.

A prior art current source with low temperature dependence is shown in FIG. 1. The current source of FIG. 1 includes a so-called reference current source 10, a bandgap type reference voltage generator 16 that receives a reference current from the reference current source, and a transconductor 18 for converting the reference voltage of the generator 16 into an output current. The current source 10 has two branches 12, 14. These branches provide a reference current which is copied to the reference voltage generator 16 by a double cascoded current mirror 20.

The reference voltage generator 16 includes a resistor 22 connected in series with a bipolar transistor 24 (PNP). The base of this transistor is connected to the collector and to a terminal 26 with a reference potential (e.g., ground). Its emitter is connected to the resistor 22. The voltage $V_{bg}$ of the generator 16, which is measured between a terminal 25 and the terminal 26, may be expressed in the form $V_{bg}=V_{EB}+R_1I$. In this expression, $V_{EB}$ is the emitter-base voltage of the transistor 24, $R_1$ is the value of the resistor 22, and I is the value of the current copied by the mirror 20 from the reference current source to the reference voltage generator 16.

The transducer 18 includes an amplifier 27 and of a transistor 28 of the metal-oxide semiconductor (MOS) type. It delivers a current $I_{out}$ in a load resistor 29 having a value $R_2$ such that $I_{out}=V_{bg}/R_2$. Thus, for a bipolar transistor such as the transistor 24, the base-emitter voltage is a negative temperature function (i.e., a negative temperature dependence coefficient). On the other hand, the values $R_1$ and $R_2$ of the resistors 22, 29, as well as the current I copied from the reference generator 10, evolve positively with the temperature.

By appropriately choosing the values of $R_1$ and I and summing the terms $V_{EB}$ and $R_1I$ it is possible to obtain, at the terminal 26, a reference voltage generator with a temperature dependence coefficient able to compensate for the temperature drifts of the load resistor 29 and of the transconductor 18. Thus, the output current $I_{out}$ may be rendered substantially insensitive to temperature. A more comprehensive description of the output source of FIG. 1 may be found in Analysis and Design of Analog Integrated Circuits, Paul R. Gray/Robert G. Meyer, 3rd edition, p. 345 (FIG. 4.50).

The current source of FIG. 1 provides very good temperature stability. Yet, it includes a large number of components and has a high power consumption. These characteristics do not lend themselves to integration of the current source in a high density integrated circuit or reduced circuit cost. Indeed, the chip surface required for such a current source integration is too great for many applications.

Another current source according to the prior art having a smaller number of components is illustrated in FIG. 2. The current source of FIG. 2 combines two individual current sources having opposite thermal behavior. The first individual source 30 is a current source with two branches coupled together by a current mirror. Such a source is known per se and delivers a current that varies in proportion to the temperature. More precisely, the current $I_a$ is such that:

$$Ia = \frac{kT}{qR_a}\ln\frac{S_2}{S_1} = \frac{\Delta V_{BE}}{R_a},$$

where k, T, q, $R_a$, $S_1$ and $S_2$ respectively represent the Boltzmann constant, the temperature, the electron charge, the value of a source current fixing resistor 34, and the surfaces of emitters of bipolar transistors 31, 32, 33 and 35 (being respectively in two branches of the source). The term $\Delta V_{BE}$ represents a magnitude such that $\Delta V_{BE}=(V_{BE33}+V_{BE32})-(V_{BE34}+V_{BE31})$, where $V_{BE33}$, $V_{BE32}$, $V_{BE34}$ and $V_{BE31}$ respectively indicate the base-emitter voltages of the transistors mentioned above.

The second individual source 40 includes a bipolar transistor 42 connected in series with a current fixing resistor 44 having a value $R_b$. It is further connected in parallel to the first current source 30. A current $I_b$ delivered by the second source is such that $I_b=$ $$I_b = \frac{V_{BE}}{R_b},$$

where $V_{BE}$ is the base-emitter voltage of the bipolar transistor 42. The current $I_b$ is inversely proportional to the temperature, i.e., to $$\frac{1}{T}.$$

Transistors 51, 52, combined with resistors 53, 54, connect the two sources 30, 40 to a first supply terminal 56, connected to a first potential ($V_{cc}$), and to a second supply terminal 58, connected to a second potential ($V_{ee}$). The transistors 51, 52 have their bases respectively connected to biasing lines 61, 62 which may be used to copy the current of the sources 30, 40 to loads (not shown). That is, they are current mirror control transistors, also not shown.

By adjusting the values $R_a$ and $R_b$ of the current fixing resistors of the two individual sources 30, 40 (and possibly the surfaces of the transistors 31, 32, 33, 35 and 42), it is possible to set the amount of current each current source contributes to the total current passing through the control transistors 51 and 52. It is also possible to set the amount of current each individual source contributes to the thermal drift of the overall source combining the two sources.

Thus, the thermal drifts of the individual sources 30, 40 are respectively proportional to the temperature (positive coefficient) and inversely proportional to the temperature (negative coefficient). As discussed previously, this is due to the fact that one of the sources is of the $$\frac{\Delta V_{BE}}{R}$$

type and the other source is of the $$\frac{V_{BE}}{R}$$

type. It is therefore possible to obtain at least a partial compensation for the drifts of the two sources, and therefore an overall source with a low temperature dependence coefficient. A more comprehensive discussion of the current source of FIG. 2 may be found in Evolution of High-Speed Operational Amplifier Architectures by Doug Smith et al., IEEE J. of SSC., Oct. 1994, vol. 29, no. 10.

FIGS. 3, 4 and 5 respectively show the temperature behavior of the first and second individual sources 30, 40 and the overall source resulting from their combination. These figures respectively show, in graphical form, the current (shown on the ordinate) as a function of the temperature (shown on the abscissa). The evolution of the current is given for two different values of the supply voltage (2.7 and 5.5 V) measured between the supply terminals. On each graph, the letters A and B respectively show the curves obtained at 2.7 and 5.5 Volts. The currents are expressed as $10^{-4}$ A and the temperatures are expressed in ° C.

It can be seen in FIG. 3 that the curves A and B have a positive slope. This is characteristic of a positive temperature dependence coefficient for the first individual source 30, i.e., the $$\frac{\Delta V_{BE}}{R}$$

source. On the other hand, FIG. 4 shows a negative temperature dependence of the individual source 40, i.e., the $$\frac{V_{BE}}{R}$$

source. Temperature drifts of the sources are generally considered to be between −55° C. and +125° C. compared with an ambient temperature of +27° C. Thus, for the first individual source 30, the drift is +33% between −55 and +27° C. and +20% between +27° C. and +125° C., i.e., an overall drift of 53% for a biasing at 2.7 volts.

For the second individual source (FIG. 4), the overall (negative) drift between −55° C. and +125° C. is −44%, again for a biasing at 2.7 volts. Furthermore, the variation in current at a fixed temperature for a biasing running from 2.7 V to 5.5 V is respectively +30% and +9% for the two individual sources.

In FIG. 5, which gives the temperature behavior for the overall source including the combination of the two individual sources, it may be seen that a bell-shaped evolution of the current as a function of the temperature for a biasing at 2.7 volts is obtained. The overall drift is 24% maximum, i.e., 16% between −55° C. and +27° C. and −21% between +27° C. and +125° C. On the other hand, for a supply voltage of 5.5 volts, the bell-shaped behavior disappears and a temperature dependence with a negative coefficient is present. The drift of the overall source is, however, reduced to −36% (−12% from −55° C. to +27° C. and −24% from 27° C. to +125° C.).

Compared with the current source of FIG. 1, the current source of FIG. 2 has a smaller number of components and a lower power consumption. On the other hand, its temperature dependence is greater and the quiescent current (at 27° C.), just like the temperature dependence coefficient, is very sensitive to the supply voltage.

SUMMARY OF THE INVENTION

An object of the invention is to provide a current source having a low temperature dependence while alleviating the limitations of the sources described above.

Another object of the invention is to provide a current source that requires a relatively smaller number of components and is therefore able to occupy a small chip surface when it is part of an integrated circuit.

Still another object of the invention is to provide a current source having a low power consumption and which is less sensitive to variations in its supply voltage.

These and other objects, features, and advantages in accordance with the invention are provided by a current source with low temperature dependence including a reference current source and at least one current mirror to copy the reference current to at least one output branch. The current mirror may be a weighted mirror, and the reference current source and the weighted current mirror may respectively have opposite temperature dependence coefficients. As used herein, a weighted mirror is a mirror which makes it possible to copy in the slave branches (i.e., the output branches) a current which is different and preferably greater than that in the master branch.

As the temperature dependence of the current mirror is opposite that of the reference current source, the temperature dependence coefficient of the overall source (reference+mirror) may be lower than that of the reference current source taken in isolation. Adjusting the characteristics of the reference source and of the mirror thus makes it possible to obtain a very low temperature dependence.

According to the invention, various embodiments may be used for making the reference current source. It may be, for example, a source of the type with a base-emitter voltage reference $$\left(\frac{V_{BE}}{R}\right).$$

. Such reference current sources are known in the art and are described, for example, in Analysis and Design of Analog Integrated Circuits, Paul R. Gray/Robert G. Meyer, 3$^{rd}$ edition, p. 324 (FIG. 4.9.*a*).

In one embodiment of the current source of the invention, a reference source with a negative temperature dependence and a current mirror with positive dependence may be selected. In this case, the positive drift of the current mirror compensates for the negative drift of the reference source when the temperature increases and vice-versa when the temperature decreases. The current mirror may include a first mirror transistor in a master branch connected to the reference current source and at least one second mirror transistor connected in each output branch. The the first transistor may further be connected in series with a weighting resistor.

The current source may include several output branches for the supply of several loads and possibly, as indicated below, to supply the reference current source itself. Indeed, to reduce still further the temperature dependence of the current source, it is possible to supply the reference current source with a supply current substantially insensitive to variations in temperature. Such a current may be provided, for example, by one of the output branches of the current mirror. Such a branch may include a transistor, known as a supply transistor, as one of the second transistors and which forms a current mirror with the first transistor of the master branch.

The weighting resistor makes it possible to obtain a weighted mirror and, in particular, a mirror capable of copying in the output branch (or branches) a current greater than the current provided by the reference current source. A weighted mirror may also be obtained by selecting in the output branch a second transistor with an emitter surface greater than that of the first transistor. By adjusting the value of the weighting resistor or the supply transistor surface, compensation may be made (by way of the mirror) for the variations in source temperature. This is expressed in practice by a mirror copy coefficient greater than 1. A current is therefore available with low sensitivity to temperature and that may be used as discussed above to supply the source via the supply transistor.

BRIEF DESCRIPTION OF THE DRAWINGS

Other characteristics and advantages of the invention will become apparent from the following description, with reference to the appended drawings, given by way of non-limitative example, in which.

DETAILED DESCRIPTION OF THE PREFERRED EMBODIMENTS

Figure 6:
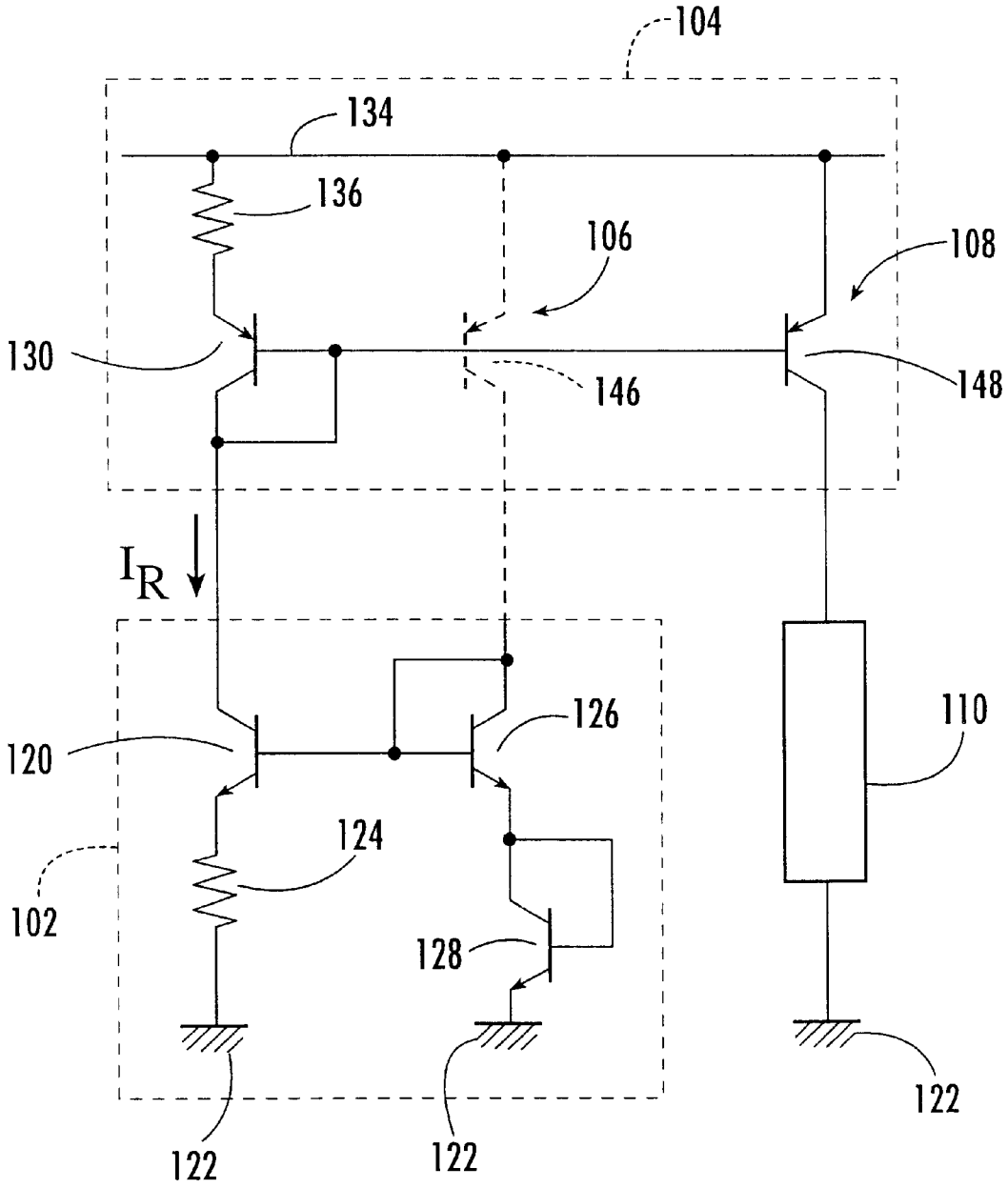
FIG. 6 is a schematic diagram of a current source according to the invention.

Turning now to FIG. 6, a current source according to the invention includes a current source 102 (i.e., a reference current source) which has no particular requirement in terms of temperature dependence. As shown, the current source 102 is a source having a negative temperature dependence coefficient. In other words, the current $I_R$ delivered by the reference source 102 decreases when the temperature increases.

The current source 102 is connected to a current mirror 104 that copies the reference current $I_R$ to one or more output branches 106, 108. A first output branch 106 provides a supply current to the reference source 102 and a second output branch 108 supplies a load 110. Although illustrated in FIG. 6, the first output branch 106 may be omitted by providing another supply for the reference current source, as will be appreciated by those of skill in the art.

The current mirror 104 (i.e., the current mirror formed with the second output branch 108) is a mirror having a positive temperature dependence coefficient. Indeed, the output branch delivers a current which, for a fixed value of the reference current $I_R$, would increase with the temperature. This tendency towards temperature drift is therefore inverse to that of the reference current source 102.

The reference current source 102 includes a first bipolar transistor 120 having its collector connected to the current mirror 104 and its emitter connected to a supply terminal 122 by a resistor 124. The supply terminal 122 may be ground, for example. The base of the first transistor 120 is connected to the base of a second diode biased transistor 126 connected in series in the first output branch 106 to a third transistor 128. That is, the third transistor 128 is connected to the emitter of the second transistor 126 by its base and by its collector. The third transistor 128 connects the second transistor 126 to the ground terminal 122.

Figure 1:
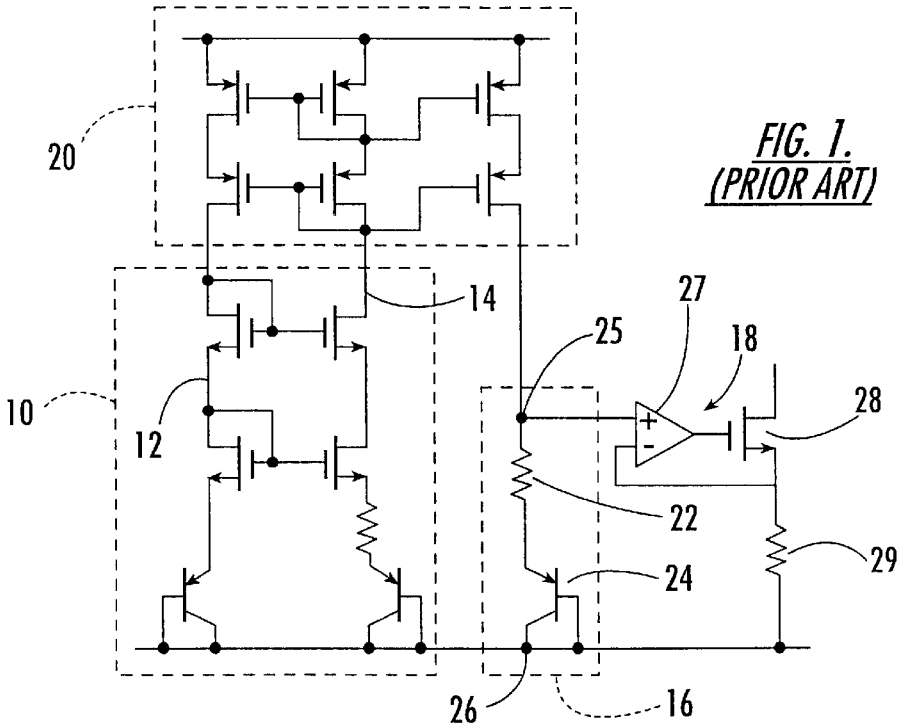
FIG. 1. (PRIOR ART)
FIG. 1 (previously described) is a schematic diagram of a first current source according to the prior art.
Figure 2:
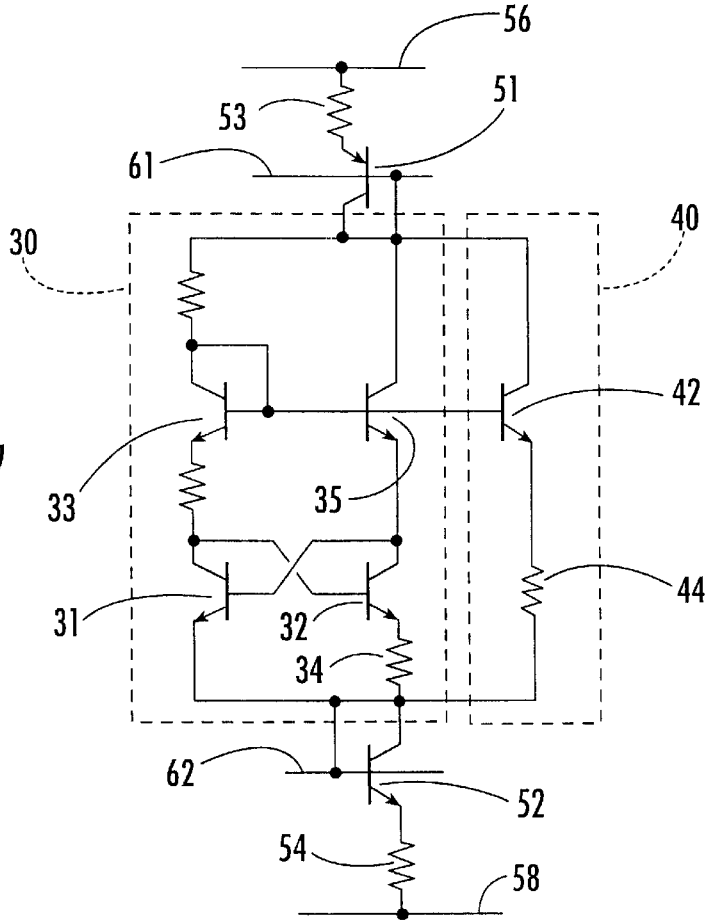
FIG. 2. (PRIOR ART)
FIG. 2 (previously described) is a schematic diagram of a second current source (a composite) according to the prior art.
Figure 3:
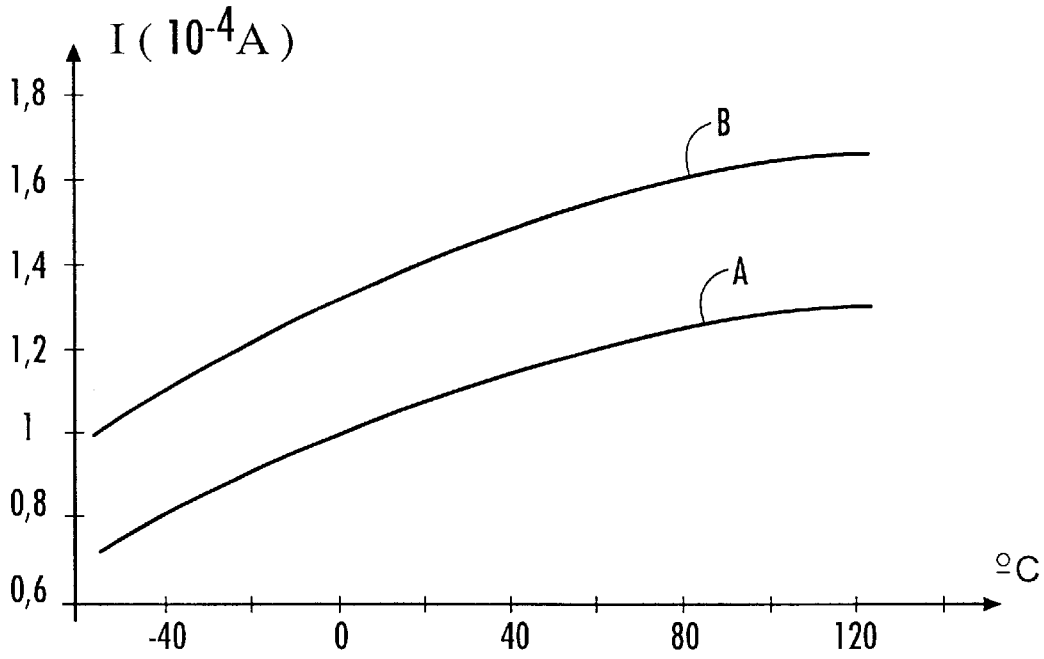
FIG. 3. (PRIOR ART)
FIGS. 3, 4 and 5 (previously described) are graphs showing the temperature behaviors of the current source of FIG. 2 and its main constituent parts.
Figure 4:
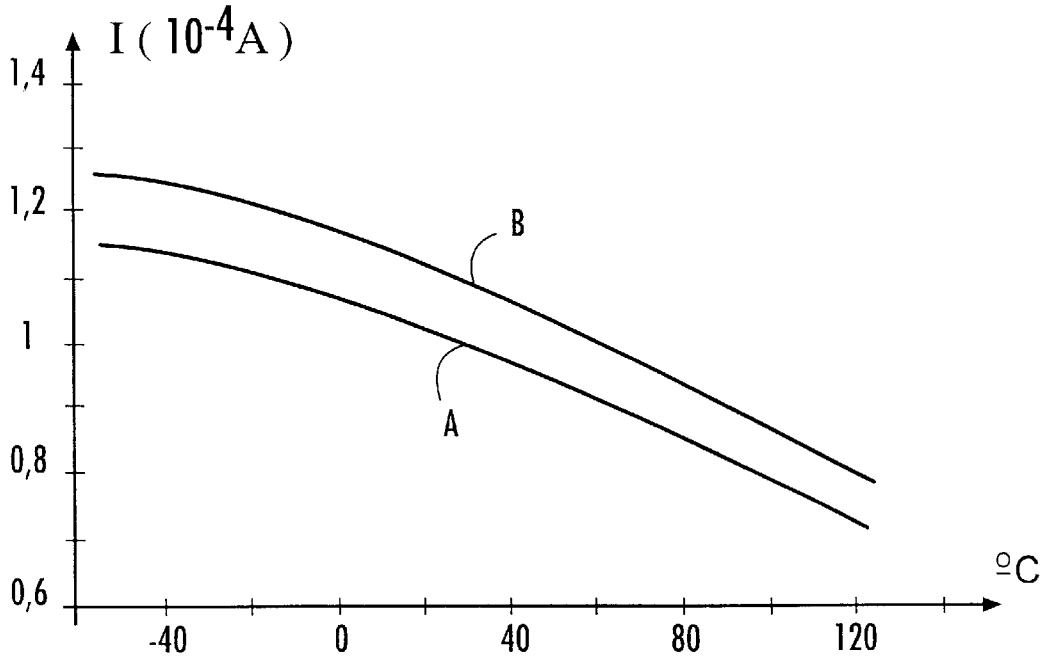
FIG. 4. (PRIOR ART)
Figure 5:
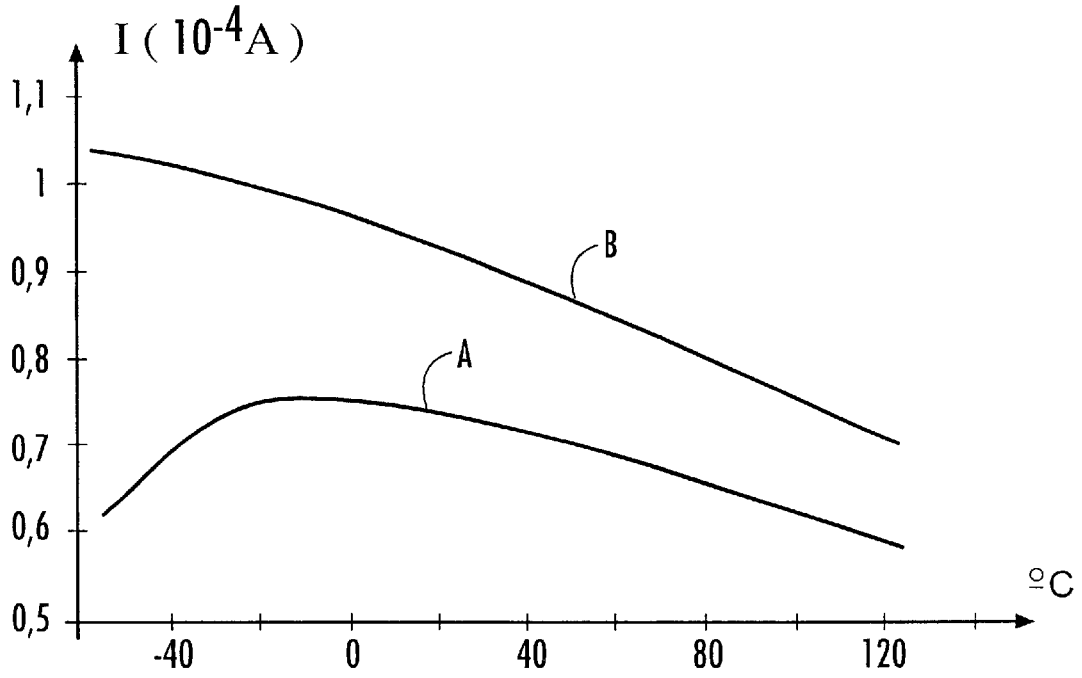
FIG. 5. (PRIOR ART)

For simplification, assuming the first and second transistors 120, 126 have approximately the same base-emitter voltages, the current $I_R$ of the reference source is:

$$I_R = \frac{V_{BE128}}{R_{124}},$$

where $V_{BE128}$ is the base-emitter voltage of the third transistor and $R_{124}$ is the value of the resistor 124 in series with the first transistor 120. As will be recalled from the above description of the prior art current source of FIG. 2, the current $I_R$ is inversely proportional to the temperature.

The current mirror 104 includes in the master branch a fourth transistor 130 connected by its base and its collector to the reference current source 102. The fourth transistor 130 also is connected by its base to the base of the transistors of the output branches, and by its emitter to the (positive) supply terminal 134. More specifically, the emitter of the fourth transistor 130 is connected to the supply terminal 134, positive in the example shown, by a resistor 136 (a weighting resistor).

Fifth and sixth bipolar transistors (PNP) 146, 148 of the current mirror 104 are connected in series respectively in the first and second output branches 106, 108. They are connected by their emitters to the positive supply terminal 134. Their bases are connected to the bases of the fourth transistor 130, as discussed above.

If the fourth, fifth and sixth transistors are identical and have approximately the same emitter surfaces, the weighting resistor 136 allows currents to be fixed in the output branches that are stronger than those in the master branch to compensate for variations in temperature of the source. Indeed, $V_{EB130}+R_pI_R=V_{EB146}=V_{EB148}$, where $V_{EB130}$, $V_{EB146}$, $V_{EB148}$ are respectively the emitter-base voltages of the transistor 130 of the master branch and of the transistors 146, 148 of the output branches and $R_p$ is the value of the weighting resistor. The transistors of the output branches may also have emitter surfaces greater than that of the transistor of the master branch of the current mirror for increasing the output current.

Adjustment of the output current by the choice of transistors (i.e., emitter surface) and of the value of the weighting resistor allows the positive temperature drift of the current mirror to be fixed. This drift may thus be adjusted to compensate, at least partly, for the drift (i.e., negative) of the reference current source. Preferably, the drift is adjusted to be minimal. Furthermore, in one embodiment, only the second output branch 108 would form a weighted mirror. In this particular case, the emitter surfaces of the transistor 130 of the master branch and of the transistor 146 of the first output branch would be selected to be identical. Further, a resistor having a value identical to that of the weighting resistor would be connected in series with the transistor of the first output branch.

Figure 7:
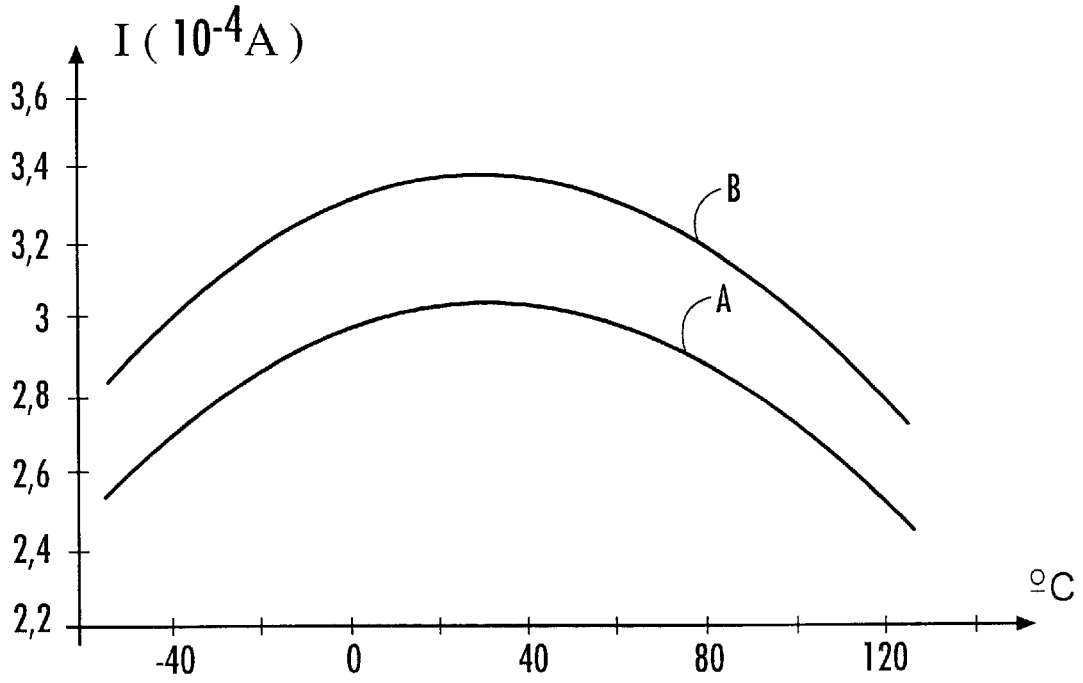
FIG. 7 is a graph showing the temperature behavior of the current source of FIG. 6.

FIG. 7 shows the temperature behavior of the source of FIG. 6. The curves A and B represent the current delivered as a function of the temperature for supply voltages of 2.7 and 5.5 volts, respectively. It may be seen that, whatever the supply voltage, a substantially bell-shaped behavior is obtained. The maximum overall drift of the current with a temperature varying between −55° C. and +27° C. and between +27° C. and +125° C. is 20% as an absolute value.

It is more precisely +16% between −55° C. and +27° C. and −20% between +27° C. and +125° C.

Compared with the known prior art current sources described above, the overall temperature drift of the current source of the invention is lower and the extent thereof is substantially unaffected by the supply voltage. Furthermore, the value of the quiescent current at 27° C. (i.e., at a fixed temperature) varies only by about 10% for a supply voltage running from 2.7 to 5.5 volts. The curves in FIG. 7 are obtained by using transistors of the current mirror that are identical to each other and by using a weighting resistor value of 60 kΩ.

That which is claimed is:

1. A current source comprising:

at least one output branch;

a reference current source providing a reference source current; and a weighted current mirror for copying the reference source current to said at least one output branch;

said reference current source and said weighted current mirror having coefficients of temperature dependence of opposite signs.

2. The current source according to claim 1 wherein said reference current source has a negative coefficient of temperature dependence and said weighted current mirror has a positive coefficient of temperature dependence.

3. The current source according to claim 1 wherein said reference current source comprises a base-emitter voltage reference source.

4. The current source according to claim 1 wherein said weighted current mirror comprises a supply transistor connected to said at least one output branch.

5. The current source according to claim 4 wherein said reference current source comprises a diode biased control transistor connected to said at least one output branch and said supply transistor.

6. The current source according to claim 1 wherein said weighted current mirror comprises:

a master branch comprising a weighting resistor and a first current mirror transistor connected in series between said weighting resistor and said reference current source; and at least one second current mirror transistor connected to said at least one output branch.

7. The current source according to claim 6 wherein said second current mirror transistor has an emitter surface greater than an emitter surface of said first current mirror transistor.

8. A current source comprising:

at least one output branch;

a reference current source providing a reference source current and comprising a base-emitter voltage reference source; and a weighted current mirror for copying the reference source current to said at least one output branch;

said reference current source having a negative coefficient of temperature dependence and said weighted current mirror having a positive coefficient of temperature dependence.

9. The current source according to claim 8 wherein said weighted current mirror comprises a supply transistor connected to said at least one output branch.

10. The current source according to claim 9 wherein said reference current source comprises a diode biased control transistor connected to said at least one output branch and said supply transistor.

11. The current source according to claim 8 wherein said weighted current mirror comprises:

a master branch comprising a weighting resistor and a first current mirror transistor connected in series between said weighting resistor and said reference current source; and at least one second current mirror transistor connected to said at least one output branch.

12. The current source according to claim 11 wherein said second current mirror transistor has an emitter surface greater than an emitter surface of said first current mirror transistor.

13. An integrated circuit comprising:

a current source comprising at least one output branch, a reference current source providing a reference source current, and a weighted current mirror for copying the reference source current to said at least one output branch, said reference current source and said weighted current mirror having coefficients of temperature dependence of opposite signs.

14. The integrated circuit according to claim 13 wherein said reference current source has a negative coefficient of temperature dependence and said weighted current mirror has a positive coefficient of temperature dependence.

15. The integrated circuit according to claim 13 wherein said weighted current mirror comprises:

a master branch comprising a weighting resistor and a first current mirror transistor connected in series between said weighting resistor and said reference current source; and at least one second current mirror transistor connected to said at least one output branch.

16. The integrated circuit according to claim 15 wherein said second current mirror transistor has an emitter surface greater than an emitter surface of said first current mirror transistor.

17. A method for supplying a reference current to at least one output branch comprising:

generating the reference current using a reference current source;

copying the reference source current to the at least one output branch using a weighted current mirror; and setting coefficients of temperature dependence of the reference current source and the weighted current mirror to have opposite signs.

18. The method according to claim 17 wherein setting comprises setting the reference current source to have a negative coefficient of temperature dependence and setting the weighted current mirror to have a positive coefficient of temperature dependence.

19. The method according to claim 17 wherein the reference current source comprises a base-emitter voltage reference source.

20. The method according to claim 17 wherein the weighted current mirror comprises a supply transistor connected to the at least one output branch.

21. The method according to claim 20 wherein the reference current source comprises a diode biased control transistor connected to the at least one output branch and the supply transistor.

22. The method according to claim 17 wherein the weighted current mirror comprises:

a master branch comprising a weighting resistor and a first current mirror transistor connected in series between the weighting resistor and the reference current source; and at least one second current mirror transistor connected to the at least one output branch.

23. The method according to claim 22 wherein the second current mirror transistor has an emitter surface greater than an emitter surface of the first current mirror transistor.

* * * * *